US008070417B2

(12) United States Patent
Ikeya et al.

(10) Patent No.: US 8,070,417 B2
(45) Date of Patent: Dec. 6, 2011

(54) DISC SHAPED IMPELLER AND FUEL PUMP

(75) Inventors: Masaki Ikeya, Obu (JP); Toshihiko Yamauchi, Obu (JP); Yuuichi Murakoshi, Obu (JP)

(73) Assignee: Aisan Kogyo Kabushiki Kaisha, Obu-shi, Aichi-ken (JP)

( * ) Notice: Subject to any disclaimer, the term of this patent is extended or adjusted under 35 U.S.C. 154(b) by 1128 days.

(21) Appl. No.: 11/840,611

(22) Filed: Aug. 17, 2007

(65) Prior Publication Data

US 2008/0056884 A1 Mar. 6, 2008

(30) Foreign Application Priority Data

Aug. 30, 2006 (JP) ..... 2006-233354

(51) Int. Cl.
*F04D 5/00* (2006.01)

(52) U.S. Cl. ..... 415/55.1; 415/55.2

(58) Field of Classification Search ..... 415/54.1, 415/55.1, 55.2, 55.3
See application file for complete search history.

(56) References Cited

U.S. PATENT DOCUMENTS

| | | | | |
|---|---|---|---|---|
| 3,964,840 | A | 6/1976 | Kamelmacher | |
| 5,702,229 | A | 12/1997 | Moss et al. | |
| 5,807,068 | A | 9/1998 | Dobler et al. | |
| 6,224,323 | B1 * | 5/2001 | Murase et al. | 415/55.1 |
| 2002/0168261 | A1 | 11/2002 | Honma | |
| 2003/0118437 | A1 | 6/2003 | Takami et al. | |
| 2003/0118438 | A1 | 6/2003 | Takayuki et al. | |
| 2003/0118439 | A1 | 6/2003 | Usui et al. | |
| 2004/0191054 | A1 | 9/2004 | Honda et al. | |
| 2005/0025616 | A1 | 2/2005 | Jang et al. | |
| 2005/0226715 | A1 | 10/2005 | Yukio et al. | |

FOREIGN PATENT DOCUMENTS

| | | |
|---|---|---|
| DE | 2500854 | 7/1975 |
| DE | 19504079 | 10/1997 |
| DE | 10261319 | 7/2003 |
| JP | 10 115265 | 5/1998 |
| JP | 2003193990 | 7/2003 |
| JP | 2003193992 | 7/2003 |
| JP | 2005299416 | 10/2005 |
| JP | 2005320961 | 11/2005 |
| WO | 99 07990 | 2/1999 |

* cited by examiner

*Primary Examiner* — Edward Look
*Assistant Examiner* — Dwayne J White
(74) *Attorney, Agent, or Firm* — Dennison, Schultz & MacDonald

(57) ABSTRACT

A disc shaped impeller may comprise an upper face and a lower face. Concavities may be repeatedly arranged along a circumferential direction on the upper face and the lower face. Each concavity may include a front surface, a back surface, an inner surface, an outer surface and a bottom surface. Each front surface may include a front-inner area formed between an inner edge of the front surface and a middle portion of the front surface. Each front-inner area may be formed in a convex shape when viewed as a longitudinal cross-section. The longitudinal cross-section is defined as a cross-section through a longitudinal plane disposed so as to be aligned along the circumferential direction.

23 Claims, 13 Drawing Sheets

DISC SHAPED IMPELLER AND FUEL PUMP

CROSS-REFERENCE TO RELATED APPLICATION

This application claims priority to Japanese Patent Application No. 2006-233354 filed on Aug. 30, 2006, the contents of which are hereby incorporated by reference into the present application.

BACKGROUND OF THE INVENTION

1. Field of the Invention

The present invention relates to impellers and fuel pumps that are provided with an impeller.

2. Description of the Related Art

Japanese Laid-open Patent Publication No. 2003-193992 discloses an impeller. The impeller is formed in a disc shape and includes an upper face and a lower face. Concavities are repeatedly arranged along a circumference direction on the upper face and the lower face. The impeller rotates centered on an axis of rotation. FIG. 15 is an enlarged drawing of the concavities 100 of a conventional impeller, and shows a plan view in which the concavities are viewed from the opening side. The arrow 105 in FIG. 15 indicates the direction of rotation for the impeller. In the present specification, a direction of rotation of the impeller is denoted by the term "front", and the direction opposite thereto is denoted by the term "back". In FIG. 15, the direction of the arrow 105 is oriented toward the "front", and the direction of the arrow 106 is oriented toward the "back". The arrow 107 in FIG. 15 is oriented in the direction toward the center of rotation of the impeller, and the arrow 108 in FIG. 15 is oriented in the direction toward the exterior of the impeller. In the present specification, the direction toward the center of rotation of the impeller (i.e., the direction of the arrow 107) is denoted by "inner", and the direction toward the exterior of the impeller (i.e., the direction of the arrow 108) is denoted by "outer". Therefore, among the sections of the inside surface of each concavity 100, reference numeral 101 denotes a "front surface", reference numeral 102 denotes a "back surface", reference numeral 103 denotes an "inner surface", and reference numeral 104 denotes an "outer surface". The back surface 102 of the concavity has a concave shape. The front surface 101 of the concavity has a convex shape. In addition, the concavity has a bottom surface.

Normally, this impeller is installed so as to be rotatable within a pump casing. On the inside surface of the pump casing, a groove is formed that extends from an upstream end to a downstream end of an area that is opposite to the group of concavities of the impeller. When the impeller is installed in the pump casing, a fuel path is formed by the group of concavities of the impeller and the groove that is formed on the inside surface of the pump casing. When the impeller rotates inside the pump casing, fuel is drawn into the fuel path. The fuel that has been drawn into the fuel path is subject to a centrifugal force caused by the rotation of the impeller. Thereby, the fuel swirls between the concavities of the impeller and the groove of the pump casing (that is, within the fuel path), and flows through the groove of the pump casing from the upstream side to the downstream side. Thereby, the fuel pressure increases, and this pressurized fuel is discharged from the downstream end of the fuel path to the outside of the pump casing.

BRIEF SUMMARY OF THE INVENTION

As described above, in a fuel pump of this type, when the impeller rotates inside the pump casing, the fuel swirls between the concavities in the impeller and the groove in the pump casing, and it thereby flows through the groove of the pump casing from the upstream side to the downstream side. If the flow in which the fuel is swirling is disrupted, it is not possible to pressurize the fuel efficiently. Therefore, pump efficiency is reduced. In contrast, when the fuel can swirl smoothly between the concavities of the impeller and the groove in the pump casing, it is possible to improve pump efficiency.

Thus, it is an object of the present teachings to provide an impeller capable of suppressing fuel flow disruptions and advantageously pressurizing the fuel.

In one aspect of the present teachings, a disc shaped impeller comprises an upper face and a lower face. A plurality of concavities are repeatedly arranged along the circumferential direction on the upper face and the lower face. Each concavity includes a front surface, a back surface, an inner surface, an outer surface, and a bottom surface. Each front surface includes a front-inner area formed between an inner end of the front surface and a middle portion of the front surface. Each front-inner area has a convex shape when viewed as a longitudinal cross-section. The longitudinal cross-section is defined as a cross-section through a longitudinal plane disposed through the thickness of the impeller and aligned along the circumferential direction.

Note that in the present specification, the portion that is denoted by the expression "middle portion (or middle point)" is determined according to the words that are used in association with expression "middle portion". For example, in the expression "between an inner edge and a middle portion", the expression "middle portion" denotes the intermediate portion between an "inner edge" and "outer edge". In addition, for example, in the expression "between a front edge and a middle portion", the expression "middle portion" denotes the intermediate portion between a "front edge" and a "back edge".

In this impeller, the front-inner area is formed in a convex shape when viewed as a longitudinal cross-section. Therefore, during the rotation of the impeller, the fuel flows into the concavities smoothly. Thus, it is possible to suppress fuel flow disruptions. That is, this impeller can advantageously pressurize the fuel.

In another aspect of the present teachings, a disc shaped impeller may comprise an upper face and a lower face. A plurality of concavities may be repeatedly arranged along the circumferential direction on the upper face and the lower face. Each concavity may include a front opening edge, which is formed at the intersection of the front surface and the upper or lower face of the impeller, and a back opening edge which is formed at the intersection of the back surface and the upper or lower face of the impeller. In this case, each front opening edge may be formed so that an inner area between the inner end of the front opening edge and the middle point of the front opening edge is formed in a convex shape and an outer area between the middle point of the front opening edge and the outer end of the front opening edge is formed in a concave shape. Each back opening edge may be formed so that an inner area between the inner end of the back opening edge and the middle point of the back opening edge is formed in a concave shape and an outer area between the middle point of the back opening edge and the outer end of the back opening edge is formed in a convex shape.

According to this impeller, the fuel flows in from the outside of each concavity into the inside of each concavity smoother. In addition, the fuel flows out from the inside of each concavity to the outside of each concavity smoother. Therefore, it is possible to prevent disruptions to the flow of the fuel.

In another aspect of the present teachings, a disc shaped impeller may comprise an upper face and a lower face. In this impeller, concavities may be repeatedly arranged along the circumferential direction on both the upper face and the lower face, and each pair of adjacent concavities may be separated by a partition wall. Each partition wall may be formed so that the width of the partition wall narrows from the middle portion of the partition wall toward the inner end of the partition wall.

According to this impeller, in comparison to a case in which the partition walls are formed such that they have a uniform thickness, the width of the inner end of the concavity widens. As a result, the fluid resistance of the fuel flowing into each concavity reduces. Therefore, the fuel can flow into each concavity smoother.

In another aspect of the present teachings, a disc shaped impeller may comprise an upper face and a lower face, wherein concavities are repeatedly arranged along the circumferential direction on both the upper face and the lower face. Each concavity on the upper face may include a first front-bottom area which is a part of the front surface in proximity to the bottom surface, and each concavity on the lower face may include a second front-bottom area which is a part of the front surface in proximity to the bottom surface.

The first front-bottom area may be inclined toward direction of rotation of the impeller. The inclination angle of the first front-bottom area with respect to the upper face of the impeller may be an acute angle W1, the angle between the bottom surface and the first front-bottom area may be an angle W2, and the total angle, which is the sum of the acute angle W1 and the angle W2, may be less than 180 degrees. The second front-bottom area may be also inclined toward the direction of rotation of the impeller. The inclination angle of the second front-bottom area with respect to the lower face of the impeller may be an acute angle W3, the angle between the bottom surface and the second front-bottom area may be an angle W4, and the total angle, which is the sum of the acute angle W3 and the angle W4, may be less than 180 degrees.

According to this impeller, the fuel that flows through the inside of each concavity from the opening toward the bottom surface is advantageously guided by the bottom surface, and the orientation of the flow is changed. Therefore, the fuel flows through the inside of a concavity smoother.

The impeller described above may be used for a fuel pump that comprises a casing for housing the impeller so that the impeller can rotate within the casing. By using the above described impeller, it is possible to provide a fuel pump that has high pump efficiency.

These aspects and features may be utilized singularly or, in combination, in order to make improved impeller and fuel pump. In addition, other objects, features and advantages of the present teachings will be readily understood after reading the following detailed description together with the accompanying drawings and claims. Of course, the additional features and aspects disclosed herein also may be utilized singularly or, in combination with the above-described aspect and features.

DETAILED DESCRIPTION OF THE INVENTION

First, the characteristics of the embodiments, which will be explained in detail below, will be listed:

Characteristic 1: The Wesco pump has a disc-shaped impeller and a pump casing that accommodates the impeller so that it is rotatable.

Characteristic 2: A group of concavities arranged repeatedly along a circumferential direction is formed on the upper face and the lower face of the impeller.

Characteristic 3: The bottom surface of each concavity is connected by a smoothly curved surface to the back surface.

Characteristic 4: Each concavity on the upper face includes a first front-bottom area which is a part of the front surface in proximity to the bottom surface, and each concavity on the lower face includes a second front-bottom area which is a part of the front surface in proximity to the bottom surface. The first front-bottom area is inclined toward the direction of rotation of the impeller with the inclination angle of the first front-bottom area with respect to the upper face of the impeller being an acute angle W1, and the angle W2 between the bottom surface and the first front-bottom area being about 90 degrees. In addition, the second front-bottom area is inclined toward the direction of rotation of the impeller with the inclination angle of the second front-bottom area with respect to the lower face of the impeller being an acute angle W3, and the angle W4 between the bottom surface and the second front-bottom area being about 90 degrees.

Figure 1:
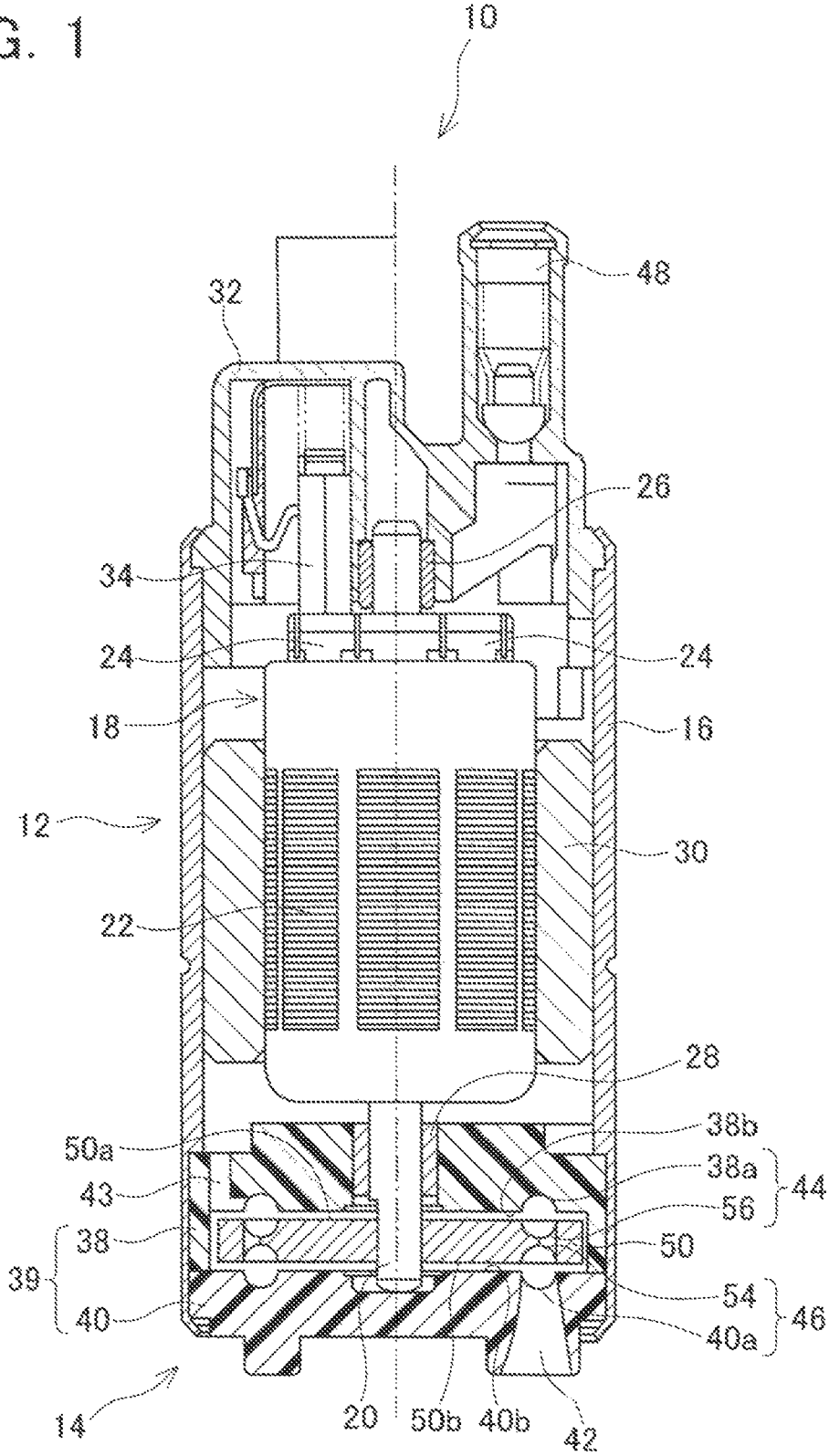
FIG. 1 is a schematic cross-sectional drawing of a Wesco pump 10.

A Wesco pump 10 according to the representative embodiment of the present teachings will be explained. The Wesco pump 10 shown in FIG. 1 is used while immersed in fuel in the fuel tank of an automobile. The Wesco pump 10 feeds fuel from the fuel tank to an engine under pressure.

As shown in FIG. 1, the Wesco pump 10 comprises a motor portion 12, a pump portion 14, and a housing 16. The motor portion 12 and the pump portion 14 are accommodated in the housing 16. The motor portion 12 has a rotor 18. The rotor 18 includes a shaft 20, a laminated iron core 22 that is fastened to the shaft 20, a coil (not illustrated) that is wound around the laminated iron core 22, and commutators 24 to which the end portion of the coil is connected. The shaft 20 is supported by bearings 26 and 28 so as to be rotatable with respect to the housing 16. Inside the housing 16, a permanent magnet 30 is fastened so as to enclose the rotor 18. Terminals (not illustrated) are provided at a top cover 32 that is installed on the upper portion of the housing 16. Electricity is supplied from these terminals to the motor portion 12. When electricity is supplied to the motor portion 12, current flows to the coil via a brush 34 and the commutators 24. Thereby, the rotor 18 rotates, and the shaft 20 also rotates. In addition, a discharge port 48 is formed on the top cover 32.

The pump portion 14 is accommodated in the bottom portion of the housing 16. The pump portion 14 is provided with a substantially disc-shaped impeller 50 and a pump casing 39 that accommodates the impeller 50.

Figure 2:
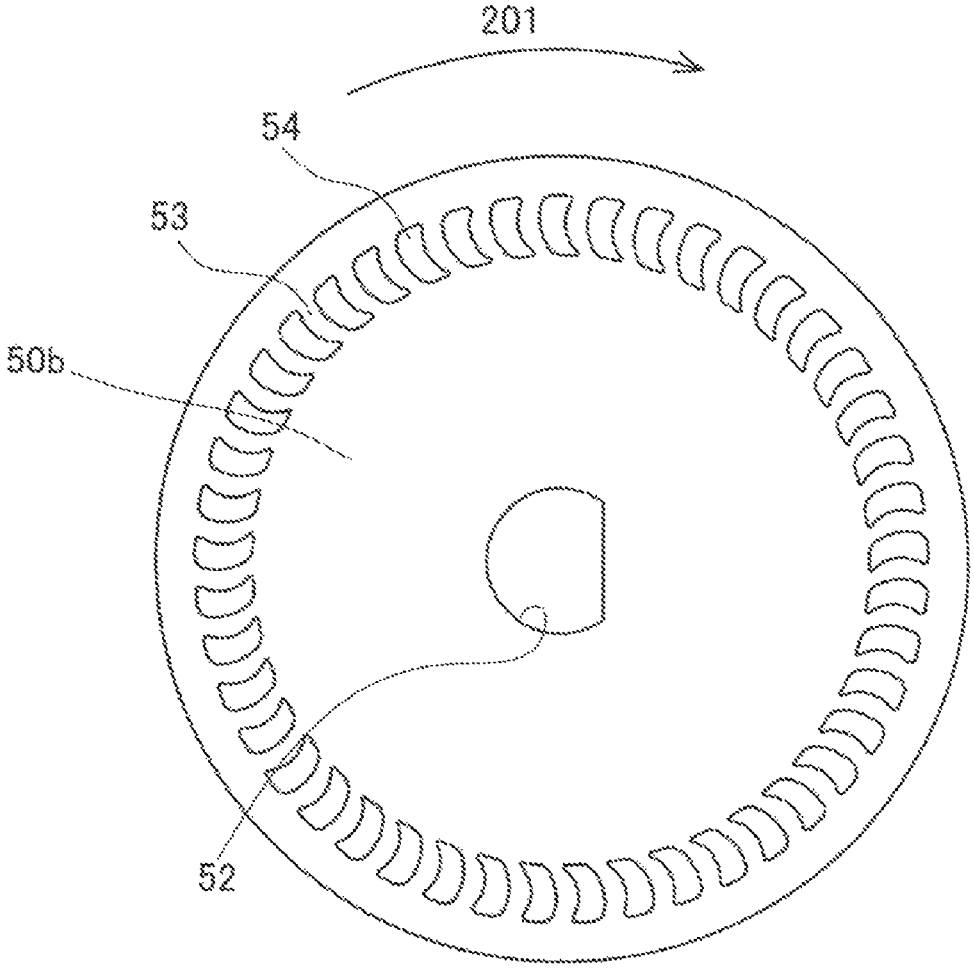
FIG. 2 is a plan drawing that shows an impeller 50 when viewed from a lower face 50*b* side.
Figure 3:
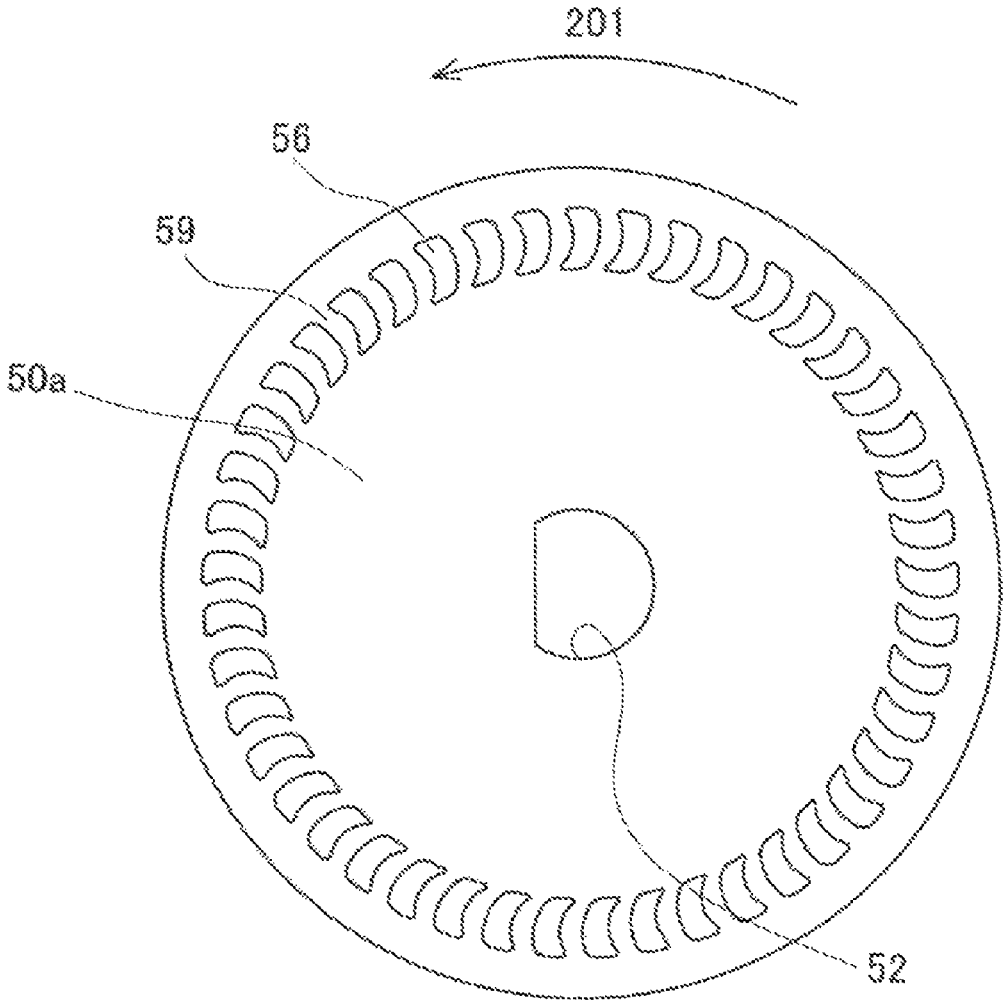
FIG. 3 is a plan drawing that shows the impeller 50 when viewed from an upper face 50*a* side.

The impeller 50 is accommodated in the pump casing 39. An upper face 50*a* and a lower face 50*b* of the impeller 50 are formed into a flat surface shape. As shown in FIG. 2 and FIG. 3, a through hole 52 that is substantially D-shaped in cross-section is formed at the center of the impeller 50. The lower end of the shaft 20 is engaged in the through hole 52. Thereby, the impeller 50 can move along the axial direction of the shaft 20, but in contrast cannot rotate relative to the shaft 20. Therefore, when the shaft 20 rotates, the impeller 50 also rotates. Note that the arrow 201 that is shown in FIG. 2 and the arrow 201 that is shown in FIG. 3 indicate the direction of rotation (that is, the "front direction") of the impeller.

As shown in FIG. 2, a group of concavities 54 in which the concavities 54 are successively arranged in the circumferential direction is formed in the lower face 50*b* of the impeller 50. The concavities 54 are all formed in an identical shape. FIG. 3 shows, a group of concavities 56 in which the concavities 56 are successively arranged in a circumferential direction is formed in the upper face 50*a* of the impeller 50. The concavities 56 are all formed in an identical shape. The shape of the concavities 56 on the upper face 50*a* directly corresponds to that of the concavities 54 of the lower face 50*b* when viewed through the impeller. Each of the concavities 56 in the upper face 50*a* is formed so as to directly correspond to each of the concavities 54 on the lower face 50*b* when viewed through the impeller 50.

As shown in FIG. 1, the structure of the pump casing 39 comprises a discharge casing 38 and an intake casing 40.

A casing face 40*b* of the intake casing 40 is formed into a flat surface shape that is parallel to the lower face 50*b* of the impeller 50. A groove 40*a* that is opposite the group of concavities 54 of the impeller 50 is formed in the casing face 40*b*.

The casing face 38*b* of the discharge casing 38 is formed into a flat surface shape that is parallel to the upper face 50*a* of the impeller 50. A groove 38*a* that is opposite the group of concavities 56 of the impeller 50 is formed in the casing face 38*b*.

The groove 38*a* and the groove 40*a* are formed such that they are substantially C shaped. The groove 38*a* and the groove 40*a* both extend from the upstream end to the downstream end along the circumferential direction of the impeller 50. An intake opening 42 that communicates with the upstream end of the groove 40*a* is formed in the intake casing 40. A discharge opening 43 that communicates with the downstream end of the groove 38*a* is formed in the discharge casing 38. A first pressurizing path (a portion of the fuel path) 46 is formed by the group of concavities 54 that are provided in the lower face 50*b* of the impeller 50 and the groove 40*a* that is formed in the intake casing 40. A second pressurizing path (a portion of the fuel path) 44 is formed by the group of concavities 56 that are provided in the upper face 50*a* of the impeller 50 and the groove 38*a* that is formed in the discharge casing 38.

Figure 4:
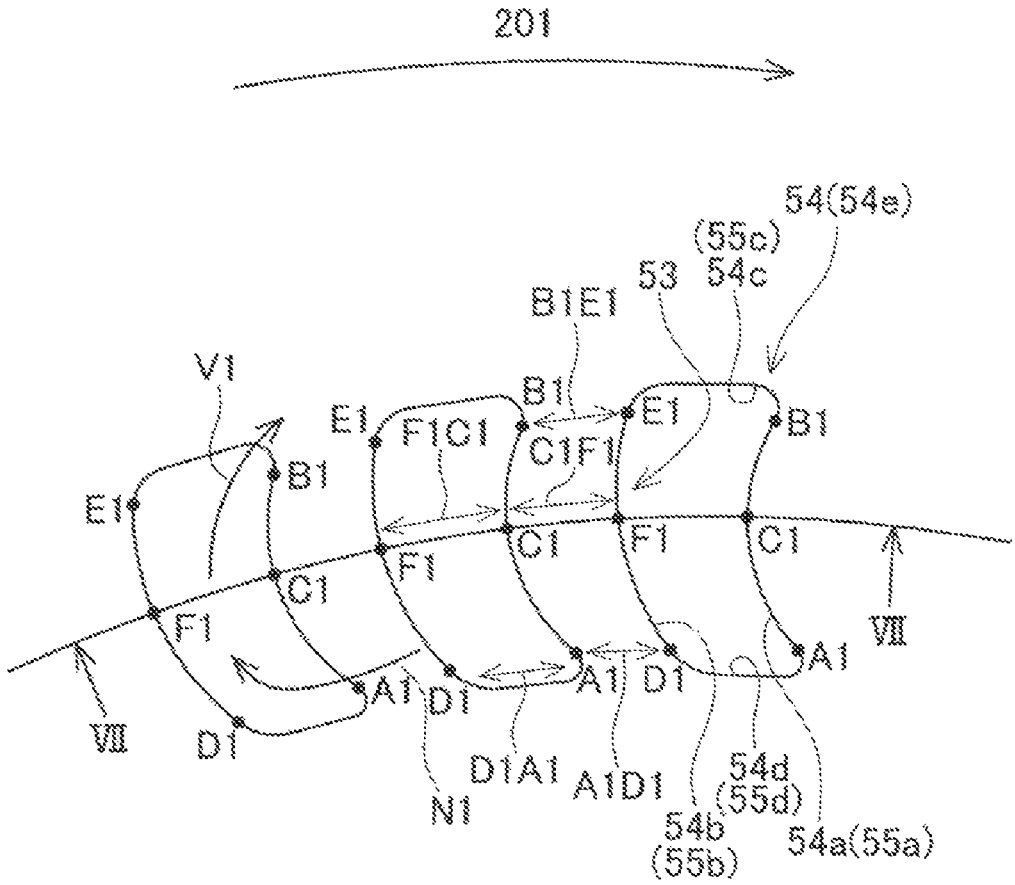
FIG. 4 is an enlarged drawing of a concavity 54.
Figure 5:
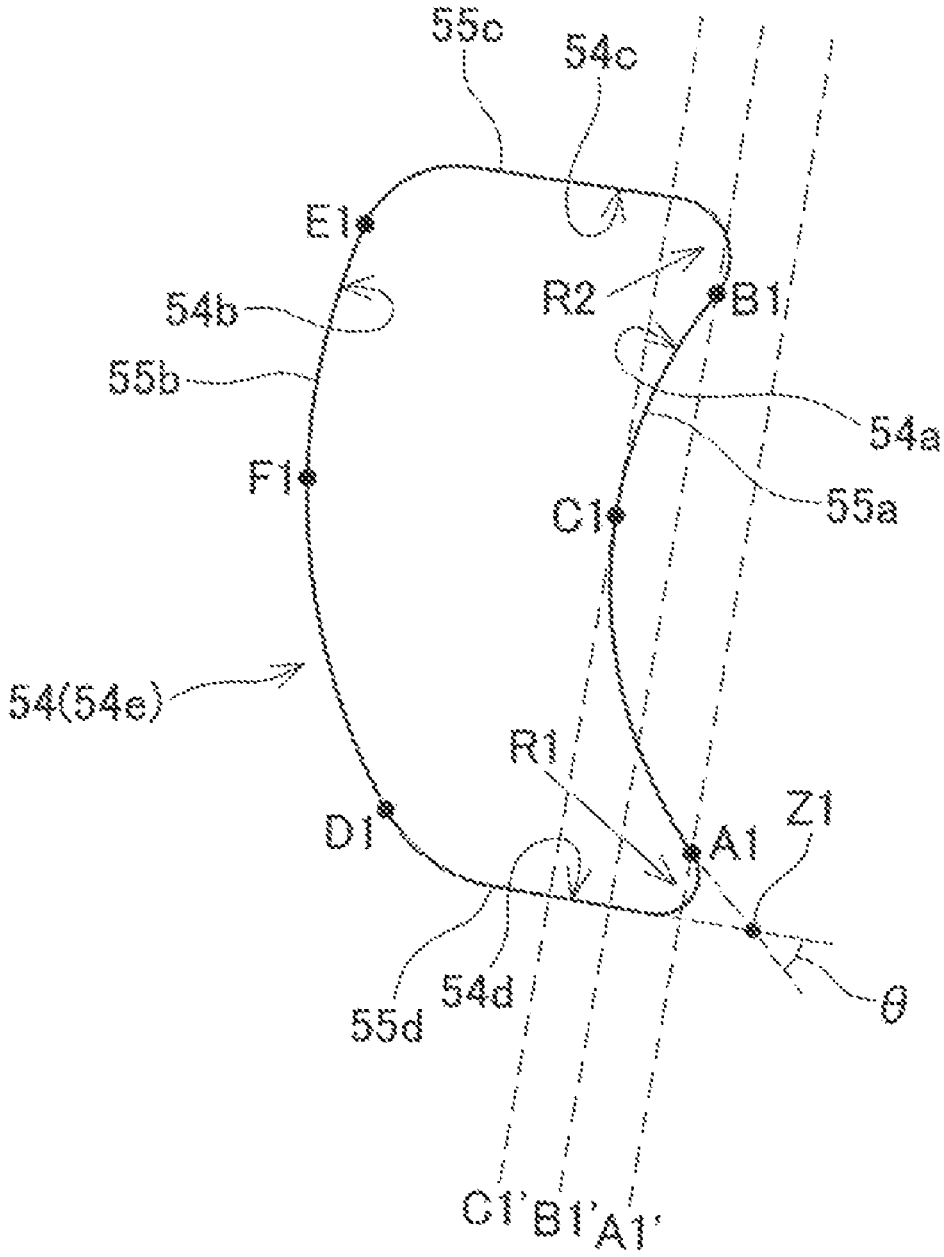
FIG. 5 is an enlarged drawing of the concavity 54.

The shape of each concavity 54 will be explained in detail. As described above, all of the concavities 54 have an identical shape. FIG. 4 and FIG. 5 show an enlarged drawing of the opening edge 54*e* of a concavity 54 when viewing the upper face 50*a* in a plan view. As shown in FIG. 5, the concavity 54 includes a front surface 54*a* in the direction of rotation of the impeller 50, a back surface 54*b* in a direction opposed to the direction of rotation of the impeller 50, an outer surface 54*c* toward the outer circumferential side of the impeller 50, and an inner surface 54*d* on the side toward the center of the impeller 50. FIGS. 4 and 5 each show the shapes of a front opening edge 55*a*, which is the opening edge of the front surface 54*a*; a back opening edge 55*b*, which is the opening edge of the back surface 54*b*; an outer opening edge 55*c*, which is the opening edge of the outer surface 54*c*; and an inner opening edge 55*d*, which is the opening edge of the inner surface 54*d*.

As will be described below, the front surface 54*a* is formed into a convex spherical shape in an area (the front-opening area 54*g* in FIG. 7) in proximity to the front opening edge 55*a*. Therefore, the front opening edge 55*a* has a convexly arced shape. The broken line A1' in FIG. 5 indicates a straight line that connects the inner end A1 of the front opening edge 55*a* and the center of the impeller 50; the broken line B1' indicates a straight line that connects the outer end B1 of the front surface 54*a* and the center of the impeller 50; and the broken line C1' indicates a straight line that connects the middle point C1 and the center of the impeller 50. The middle point C1 is an intermediate point between the inner end A1 and the outer end B1. As can be understood from the broken lines A1' to C1', the middle point C1 is positioned closest to the back on the front opening edge 55*a*, and the inner end A1 is positioned closest to the front on the front opening edge 55*a*.

The back surface 54*b* of the concavity 54 is formed such that the cross-sectional shape thereof parallel to the lower face 50*b* of the impeller 50 has a concave arc shape. Therefore, the back opening edge 55*b* has a concave arc shape. On the back opening edge 55*b*, the middle point F1 between an inner end D1 and an outer end E1 is positioned closest to the back, and the inner end D1 is positioned closest to the front.

Figure 9:
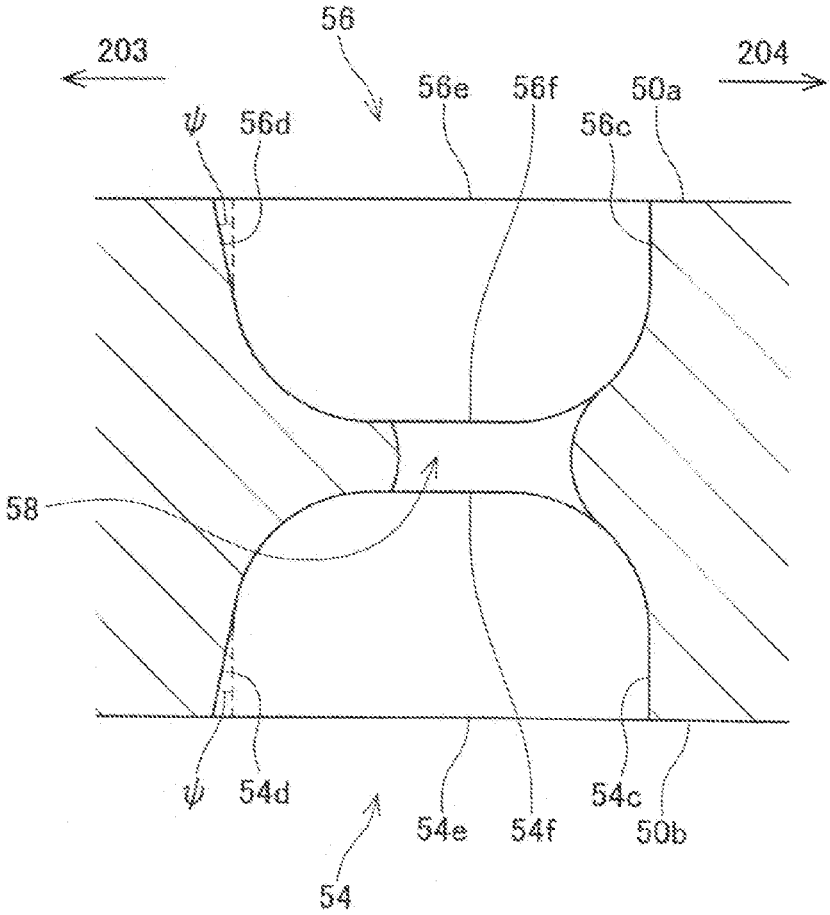
FIG. 9 is a cross-sectional drawing along the line IX-IX in FIG. 7.

The outer surface 54*c* of the concavity 54 is formed into a planar shape that is substantially parallel to the circumferential direction of the impeller 50 and perpendicular to the upper face 50*a* of the impeller 50 (refer to FIG. 9). Specifically, the outer surface 54*c* is formed into a planar shape that is substantially parallel to the tubular surface that is centered on the axis of rotation of the impeller 50. Therefore, the outer opening edge 55*c* has a substantially linear shape.

The inner surface 54*d* of the concavity 54 is formed into a planar shape. Therefore, the inner opening edge 55*d* has a substantially linear shape. The inner surface 54*d* is substantially parallel to the circumferential direction of the impeller 50. In addition, the inner surface 54*d* is inclined toward the center of the impeller. As shown in FIG. 9, the inner surface 54*d* is inclined by an angle $\psi$ with respect to the thickness direction of the impeller 50.

The front surface 54*a* and the inner surface 54*d* are connected by a smooth curved surface. Therefore, the front opening edge 55*a* and the inner opening edge 55*d* are smoothly connected. The front opening edge 55*a* and the inner opening edge 55*d* are connected by an arc with a radius R1. The point Z1 in FIG. 5 indicates where the line that extends the front opening edge 55*a* to the center of the impeller 50 and the line that extends the inner opening edge 55*d* in a rotating direction of the impeller 50 intersect. The angle $\theta$ between the line extending from the front opening edge 55*a* and the line extending from the inner opening edge 55*d* at the point Z1 is approximately 40° (i.e., less than 60°).

The front surface 54*a* and the outer surface 54*c* are connected by a smooth curved surface. Therefore, the front opening edge 55*a* and the outer opening edge 55*c* are smoothly connected. The front opening edge 55*a* and the outer opening edge 55*c* are connected by an arc that has a radius R2, which is larger than the radius R1.

The back surface 54*b* and the inner surface 54*d* are connected by a smooth curved surface. Therefore, the back opening edge 55*b* and the inner opening edge 55*d* are smoothly connected. The back opening edge 55*b* and the inner opening edge 55*d* are connected by an arc.

The back surface 54*b* and the outer surface 54*c* are connected by a smooth curved surface. Therefore, the back opening edge 55*b* and the outer opening edge 55*c* are smoothly connected. The back opening edge 55*b* and the outer opening edge 55*c* are connected by an arc.

As shown in FIG. 2, adjacent concavities 54 are separated by a partition wall 53. As all of the concavities 54 have an identical shape, all of the partition walls 53 have an identical shape. As shown in FIG. 4, each partition wall 53 includes a middle portion (the portion shown by the arrow C1F1 in FIG. 4) between an inner edge (the portion shown by the arrow A1D1 in FIG. 4) and an outer edge (the portion shown by the arrow B1E1 in FIG. 4). The thickness of the partition wall 53 is thickest at the middle portion C1F1. The partition wall 53 becomes thinner across its thickness from the middle portion C1F1 toward the inner edge A1D1, and becomes thinner from the middle portion C1F1 toward the outer edge B1E1.

Next, the shape of the concavity 56 will be explained. As described above, all of the concavities 56 have an identical shape. The concavity 56 has a shape that directly corresponds to that of the concavity 54 when viewed through the impeller 50.

Figure 6:
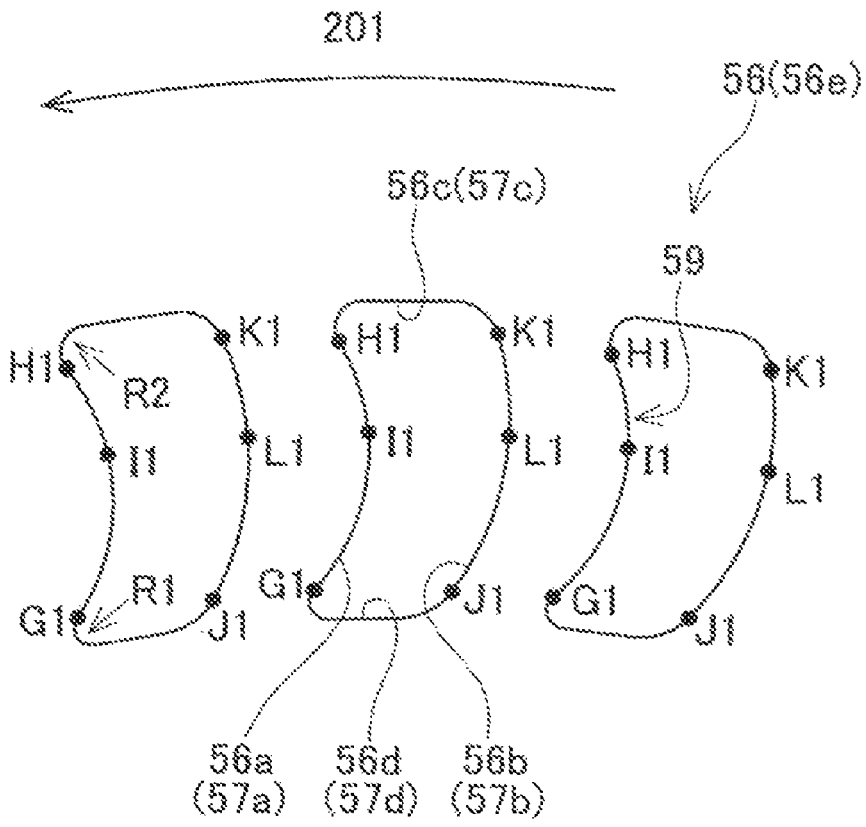
FIG. 6 is an enlarged drawing of a concavity 56.

FIG. 6 shows an enlarged drawing of the opening edge 56*e* of a concavity 56. As shown in FIG. 6, each of the concavities 56 includes a front surface 56*a*, a back surface 56*b*, an outer surface 56*c*, and an inner surface 56*d*.

As will be described below, the front surface 56*a* of each concavity 56 is formed into a convex spherical shape at an area (a front-opening area 56*g* in FIG. 7) in proximity to a front opening edge 57*a*. Therefore, the front opening edge 57*a* is a convex arc. At the front opening edge 57*a*, the middle point I1 between the inner end G1 and the outer end H1 is positioned closest to the back side on the front opening edge 57*a*, and the inner end G1 is positioned closest to the front side on the front opening edge 57*a*.

The back surface 56*b* of the concavity 56 is formed such that the cross-sectional shape parallel to the upper face 50*a* of the impeller 50 has a concavely arced shape. Therefore, the back opening edge 57*b* has a concavely arced shape. At the back opening edge 56*b*, the middle point L1 between the inner end J1 and the outer end K1 is positioned closest to the back on the back opening edge 56*b*, and the inner end J1 is positioned closest to the front on the back opening edge 56*b*.

As shown in FIG. 9, the outer surface 56*c* of the concavity 56 is formed into a planar shape that is substantially parallel to the circumferential direction of the impeller 50 and perpendicular to the upper face 50*a* of the impeller 50. Therefore, the opening edge line 57*c* of the outer surface 56*c* has a substantially linear shape.

The inner surface 56*d* of the concavity 56 is formed into a planar shape that is substantially parallel to the circumferential direction of the impeller 50 and inclines toward the inner circumferential side of the impeller 50. The inner surface 56*d* inclines ψ degrees with respect to the thickness direction of the impeller 50. Therefore, the inner opening edge 57*d* has a substantially linear shape.

The front surface 56*a* and the inner surface 56*d* are connected by a smooth curved surface. The front opening edge 57*a* and the inner opening edge 57*d* are connected by an arc that has a radius R1. An angle θ at which the line extending from the front opening edge 57*a* and the line extending from the inner opening edge 57*d* intersect is approximately 40° (i.e., less than 60°).

The front surface 56*a* and the outer surface 56*c* are connected by a smooth curved surface. The front opening edge 57*a* and the outer opening edge 57*c* are connected by an arc that has a radius R2, which is larger than the radius R1.

The back surface 56*b* and the inner surface 56*d* are connected by a smooth curved surface. The back opening edge 57*b* and the inner opening edge 57*d* are connected by an arc.

The back surface 56*b* and the outer surface 56*c* are connected by a smooth curved surface. The back opening edge 57*b* and the outer opening edge 57*c* are connected by an arc.

All of the partition walls 59 that separate adjacent concavities 56 have an identical shape. The partition wall 59 has a shape that directly corresponds to the partition wall 53 when viewed through the impeller 50. Specifically, each partition wall 59 is formed such that the middle portion between the inner end and the outer end thereof thickens, and the partition wall 59 becomes thinner from the middle portion toward the inner edge and becomes thinner from the middle portion toward the outer edge.

Figure 7:
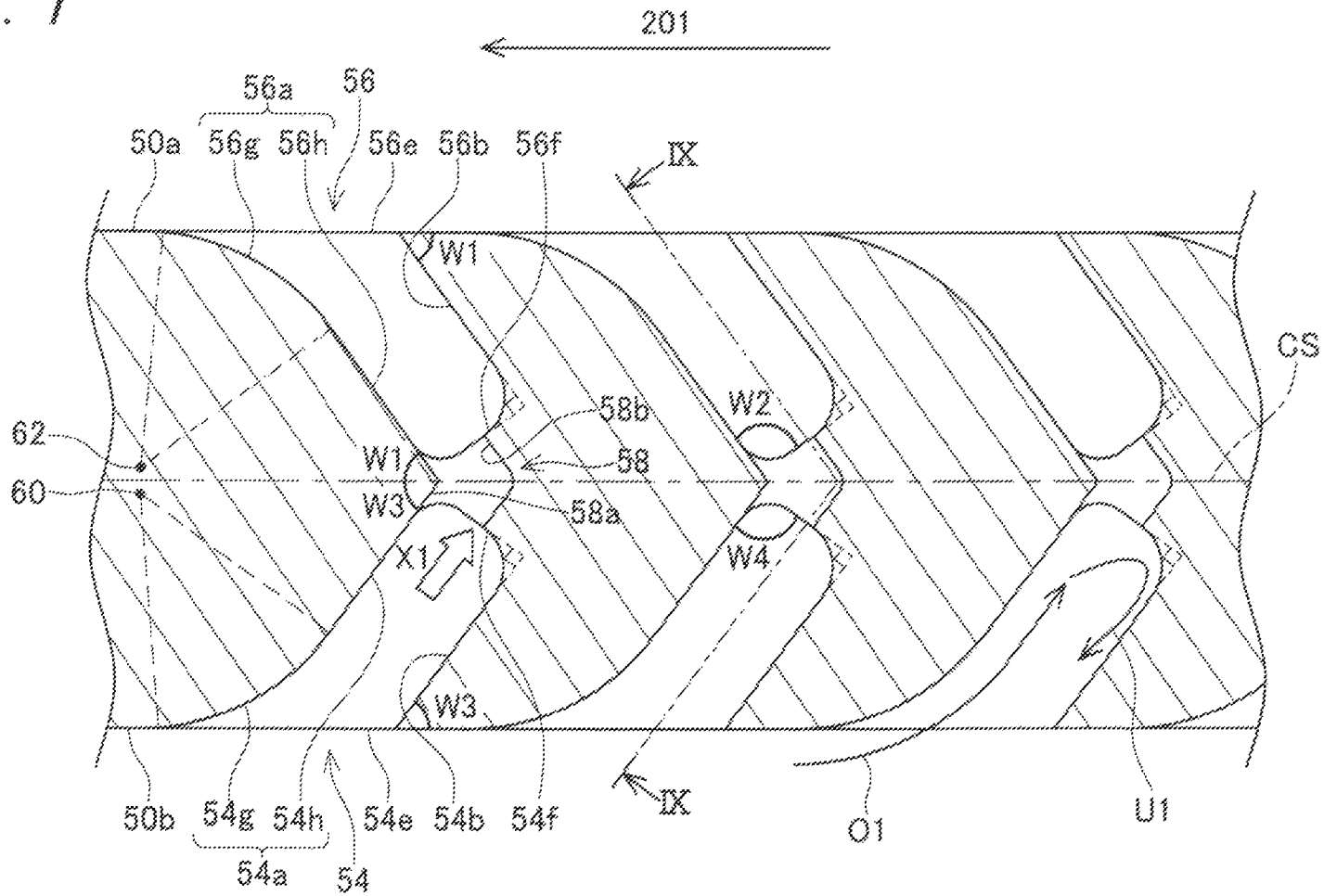
FIG. 7 is a cross-sectional drawing along the line VII-VII in FIG. 4.

FIG. 7 shows a cross-sectional drawing along the line VII-VII in FIG. 4. Specifically, FIG. 7 shows the shape of a longitudinal cross-section along the circumferential direction of the impeller.

As shown in FIG. 7, the back surface 54*b* is formed such that the longitudinal cross-sectional shape along the circumferential direction of the impeller is linear. The back surface 54*b* of the concavity 54 is inclined in direction of rotation of the impeller 50. In the longitudinal cross-section along the circumferential direction of the impeller, the angle W3 between the back surface 54*b* and the lower face 50*b* is about 60°.

The area 54*g* (i.e., the front-opening area 54*g*) of the concavity 54 near the opening of the front surface 54*a* is formed into a convex spherical shape that is centered on the point 60. The area 54*h* (i.e., the front-bottom area 54*h*) of the front surface 54*a* near the bottom surface 54*f* is formed such that the longitudinal cross-sectional shape along the circumferential direction of the impeller is linear. The front-bottom area 54*h* is inclined in the direction of the rotation of the impeller 50. The reference symbol CS in FIG. 7 indicates a flat surface that corresponds to the medium portion of the impeller in a thickness direction. In a longitudinal cross-section along the circumferential direction of the impeller, the angle between the front-bottom area 54*h* and the medium portion CS is the same as the angle W3. That is, the front-bottom area 54*h* and the back surface 54*b* are inclined at a substantially identical angle with respect to the impeller 50.

The bottom surface 54*f* of the concavity 54 is formed into a flat surface shape that is substantially at right angles to the front-bottom area 54*h* of the front surface 54*a* and the back surface 54*b*. Specifically, an angle W4 between the bottom surface 54*f* and the front-bottom area 54*h* is about 90°. The bottom surface 54*f* and the back surface 54*b* are smoothly connected by a curved surface.

The back surface 56*b* of the concavity 56 is formed such that the longitudinal cross-sectional shape along the circumferential direction of the impeller is linear. The bottom surface 56*f* and the back surface 56*b* are smoothly connected by a curved surface.

The back surface 56*b* is inclined in the direction of rotation of the impeller 50. In the longitudinal cross-section along the circumferential direction of the impeller, the angle W1 between the back surface 56*b* and the upper face 50*a* is about 60°.

The front-opening area 56*g* of the front surface 56*a* is formed in a convex spherical shape that is centered on the point 62. The front-bottom area 56*h* of the front surface 56*a* is formed such that the longitudinal cross-sectional shape along the circumferential direction of the impeller is linear. The front-bottom area 56*h* inclines in the direction of the rotation of the impeller 50. In a longitudinal cross-section along the circumferential direction of the impeller, the angle between the front-bottom area 56*h* and the medium portion CS is the same as the angle W1.

The bottom surface 56*f* of the concavity 56 is formed into a planar shape that is substantially at right angles to the front-bottom area 56*h* of the front surface 56*a* and the back surface 56*b*. Specifically, the angle W2 between the bottom surface 56*f* and the front-bottom area 56*h* is about 90°. The bottom surface 56*f* and the back surface 56*b* are smoothly connected by a curved surface.

Figure 8:
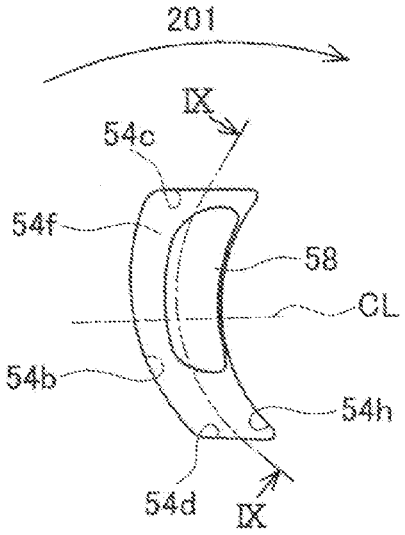
FIG. 8 is a drawing in which a bottom surface 54*f* is viewed from the direction of the arrow X1 in FIG. 7.

As shown in FIG. 7, a through-hole 58 is formed in the impeller 50, the through-hole 58 communicates with the bottom surface 54*f* of the concavity 54 and the bottom surface 56*f* of the corresponding concavity 56. FIG. 8 shows a drawing in which the bottom surface 54*f* is viewed from the direction indicated by the arrow X1 in FIG. 7. The line IX-IX in both FIG. 7 and FIG. 8 indicates the position of the middle portion between the front-bottom area 54*h* and the back surface 54*b*. As shown in FIG. 7 and FIG. 8, the lower end of the through-hole 58 opens into an area more toward the front side than the middle portion (i.e., line IX-IX). Specifically, the lower end of the through-hole 58 opens at a position that is offset toward the front side of the bottom surface 54*f*. Thereby, the opening of the through-hole 58 in the front side area of the bottom surface 54*f* (i.e., the area more toward the front side than the middle portion IX-IX between the front surface 54*a* and the back surface 54*b*) has an area larger than the area of the opening of the through-hole 58 in the back side area of the bottom surface 54*f* (i.e., the area more toward the back side than the middle portion IX-IX) (refer to FIG. 7 and FIG. 8). In addition, the lower end of the through-hole 58 opens at a position that is offset toward the outer side of the bottom surface 54*f*. Thereby, the opening of the through-hole 58 in the outer side area of the bottom surface 54*f* (i.e., the area more toward the outer side than the middle portion CL between the inner surface 54*d* and the outer surface 54*c*) has an area larger than the area of the opening of the through-hole 58 in the inner side area of the bottom surface 54*f* (i.e., the area more toward the inner side than the middle portion CL) (refer to FIG. 8).

The upper end of each through-hole 58 is formed such that it is substantially identical to the lower end of the through-hole 58. Specifically, the opening of the upper end of the through-hole 58 is positioned such that it is offset to the front side of the bottom surface 56*f*. In addition, the opening of the upper end of the through-hole 58 is positioned such that it is offset to the outer side of the bottom surface 56*f*.

In an area of the impeller 50 that is lower than the medium portion CS, the front surface 58*a* of the through-hole 58 is inclined at an angle that is substantially identical to that of the front-bottom area 54*h* of the concavity 54. The front surface 58*a* lower than the medium portion CS forms a continuous surface with the front-bottom area 54*h*. In an area of the impeller 50 that is lower than the medium portion CS, the back surface 58*b* of the through-hole 58 is inclined at an angle that is substantially identical to that of the back surface 54*b* of the concavity 54. In an area of the impeller 50 that is higher than the medium portion CS, the front surface 58*a* is inclined at an angle that is identical to that of the front-bottom area 56*h* of the concavity 56. The front surface 58*a* higher than the medium portion CS forms a continuous surface with the front-bottom area 56*h*. In an area of the impeller 50 that is higher than the medium portion CS, the back surface 58*b* of the through-hole 58 is inclined at an angle that is substantially identical to that of the back surface 56*b* of the concavity 56.

FIG. 9 shows a cross-section of the impeller 50 taken through the line IX-IX that is shown in FIG. 7 and FIG. 8. Note that the arrow 203 in FIG. 9 indicates the direction toward the center of the impeller 50 (that is, the "inner direction"), and the arrow 204 indicates the direction toward the exterior of the impeller 50 (that is, the "outer direction"). As described above, the outer surface 54*c* of the concavity 54 is substantially perpendicular to the lower face 50*b* of the impeller 50, and it is formed into a planar shape that is substantially parallel to the tubular surface that is centered on the axis of rotation of the impeller 50. The inner surface 54*d* of the concavity 54 is formed into a planar shape that is inclined by an angle ψ toward the center of the impeller 50. The bottom surface 54*f* of the concavity 54 is shaped such that it is substantially parallel to the lower face 50*b* of the impeller 50 when viewed as the cross-section taken through the line IX-IX. The outer surface 54*c* and the bottom surface 54*f* are smoothly connected by a curved surface. The inner surface 54*d* and the bottom surface 54*f* are also smoothly connected by a curved surface.

In addition, as described above, the outer surface 56*c* of the concavity 56 is substantially perpendicular to the upper face 50*a* of the impeller 50. Furthermore, the inner surface 56*d* of the concavity 56, which is formed into a planar shape that is substantially parallel to the tubular surface that is centered on the axis of rotation of the impeller 50, is formed into a planar shape that is inclined by an angle ψ toward the center of the impeller 50. The bottom surface 56*f* of the concavity 56 is formed such that it is substantially parallel to the upper face 50*a* of the impeller 50 when viewed as the cross-section taken along the line IX-IX. The outer surface 56*c* and the bottom surface 56*f* are smoothly connected by a curved surface. The inner surface 56*d* and the bottom surface 56*f* are also smoothly connected by a curved surface.

Next, the operation of the Wesco pump 10 will be explained.

When current flows to the coil of the rotor 18 via the brush 34 and the commutators 24, the rotor 18 rotates, and the shaft 20 thereby rotates. As a result, the impeller 50 rotates inside the pump casing 39. When the impeller 50 rotates, fuel is drawn from the intake opening 42 into the pump portion 14. The fuel that has been drawn into the pump portion 14 flows into the first pressurizing path 46. The fuel that has flown into the first pressurizing path 46 flows from an upstream side to a downstream side through the first pressurizing path 46 due to the rotation of the impeller 50. In addition, due to the centrifugal force caused by the rotation of the impeller 50, the fuel flows while swirling in the first pressurizing path 46, as shown by the arrows M1, P1, Q1, and R1 in FIG. 10.

Figure 10:
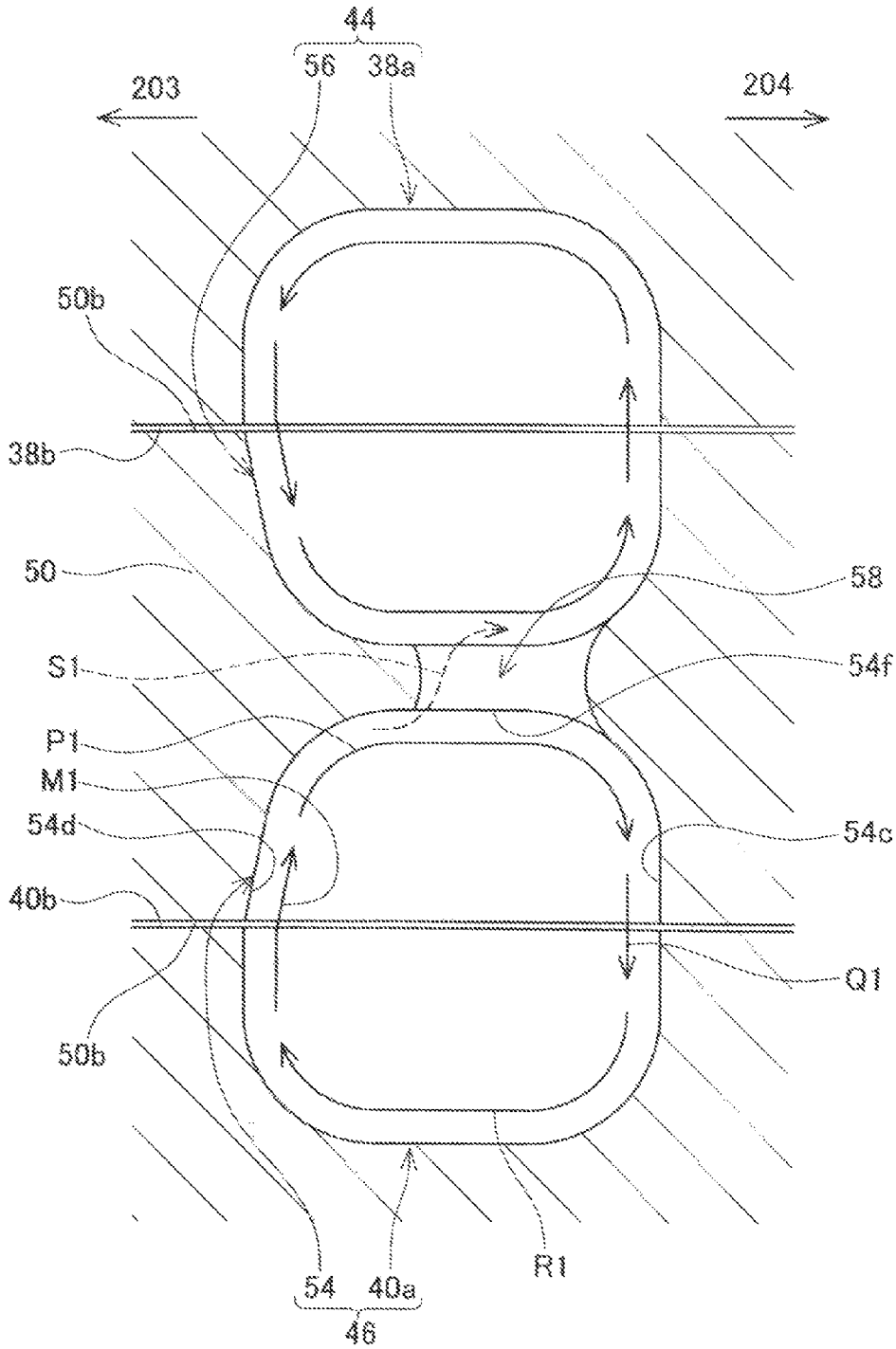
FIG. 10 is an explanatory drawing that shows the flow of fuel in pressurizing paths 44 and 46.

When the fuel swirls inside the first pressurizing path 46, as shown by the arrow M1 in FIG. 10, the fuel flows from the groove 40*a* into the concavity 54 through the inner surface 54*d* side. Then the fuel flows from the groove 40*a* into the concavity 56 from the front side toward the back side. Specifically, as shown by the arrow N1 in FIG. 4, the fuel flows from the vicinity of the inner end A1 of the front surface 54*a* and the inner end D1 of the back surface 54*b* into the concavity 54.

As described above, the front opening edge 55*a* is formed such that the inner end A1 thereof is positioned closest to the front side, and the middle point C1 thereof is positioned closest to the back side. In addition, the back opening edge 55*b* is structured such that the inner end D1 thereof is positioned closest to the front side, and the middle point E1 thereof is positioned closest to the back side. In addition, the concavity 54 is formed such that the angle between the front opening edge 55*a* and the inner opening edge 55*d* is 40° (i.e., less than 60°). In addition, the front surface 54*a* and the inner surface 54*d* are connected by a smooth curved surface, and thereby the front opening edge 55*a* and the inner opening edge 55*d* are connected by an arc that has a radius R1. Therefore, the fuel flows smoothly from the groove 40*a* into the concavity 54. Fuel flow disruptions are thereby suppressed.

In addition, as described above, the partition wall 53 that separates the concavities 54 is formed such that the middle portion C1F1 thereof thickens, and the partition wall 53 becomes thinner from the middle portion C1F1 toward the inner edge A1D1 (refer to FIG. 4). Because the partition wall 53 is structured in such a manner, compared to a case in which the partition wall 53 is formed with a uniform thickness, the width (the arrow D1A1 in FIG. 4) of the inner end of the concavity 54 becomes wider. Therefore, the fluid resistance of the fuel flowing into the concavity 54 reduces, and it is possible for a substantial amount of fuel to flow into the concavity 54.

Note that, in the present representative embodiment, the partition wall 53 that separates the concavities 54 is formed so as to become thinner from the center portion C1F1 thereof toward the outer edge B1E1 thereof, but the outer edge B1E1 need not be formed so as to be thinner than the center portion C1F1.

In addition, as described above, the front-opening area 54*g* of the concavity 54 has a convex spherical shape. Therefore, the longitudinal cross-sectional shape of the front-opening area 54*g* (i.e., the longitudinal cross-sectional shape of the longitudinal cross-section along the circumferential direction of the impeller 50) has a convex circular shape. Therefore, the fuel flows smoothly from the groove 40*a* into the concavity 54, as shown by the arrow O1 in FIG. 7. Therefore, fuel flow disruptions are suppressed (i.e., fuel flows that separate off from the front-opening area 54*g* is suppressed).

As shown by the arrow P1 in FIG. 10, the fuel that has flown into the concavity 54 is guided by the bottom surface 54*f*. Thereby, the orientation of the fuel flow changes. As described above, the inner surface 54*d* of the concavity 54 is inclined by an angle ψ toward the center of the impeller 50. Therefore, when the fuel flows into the concavity 54, the fuel is guided by the inner surface 54*d*. Thereby, the orientation of the fuel flow changes slightly (refer to the arrow M1 in FIG. 10). In this manner, the fuel is guided by the inner surface 54*d* when flowing in. Therefore, as shown by the arrow P1, when the orientation of the flow changes in the concavity 54, the fuel flow disruptions are suppressed.

In addition, as described above, the bottom surface 54*f* of the concavity 54 is smoothly connected to the outer surface 54*c* and the inner surface 54*d* by the curved surface. Therefore, as shown by the arrow P1 in FIG. 10, the orientation of the fuel flow changes smoothly. Fuel flow disruptions are thereby suppressed (i.e., the occurrence of stagnation in the fuel flow is suppressed).

In addition, as described above, the bottom surface 54*f* of the concavity 54 is formed into a flat surface that is substantially perpendicular to the front-bottom area 54*h* of the back surface 54*b* and the front surface 54*a* (refer to FIG. 7). In addition, the bottom surface 54*f* is smoothly connected to the back surface 56*b* by a curved surface. Therefore, as shown by the arrow U1 in FIG. 7, the orientation of the fuel flow changes smoothly. Fuel flow disruptions are thereby suppressed (i.e., the occurrence of stagnation in the fuel flow is suppressed).

The fuel that has flowed into the concavity 54 flows out of the concavity 54 into the groove 40*a* through the outer surface 54*c*, as shown by the arrow Q1 in FIG. 10 and by the arrow V1 in FIG. 4.

As described above, the front surface 54*a* and the outer surface 54*c* are connected by a smooth curved surface. Therefore, the front opening edge 55*a* and the outer opening edge 55*c* are connected by an arc that has a radius R2 (>radius R1). Because such a concavity 54 is formed, the fluid resistance of the fuel flowing out is lower than the fluid resistance of the fuel flowing in (arrow N1 in FIG. 4). Therefore, the fuel in the concavity 54 can flow out to the groove 40*a* smoothly. Fuel flow disruptions in the concavity 54 can thereby be suppressed.

The fuel that flows out to the groove 40*a* flows as shown by the arrow R1, then flows back into the concavity 54 again, as shown by the arrow M1. In this manner, the fuel flows from the upstream side to the downstream side while swirling inside the first pressurizing path 46.

As has been explained above, the fuel inside the first pressurizing path 46 flows from the upstream side toward the downstream side while smoothly swirling. Thereby, the fuel is advantageously pressurized while flowing through the first pressurizing path 46.

While the fuel in the first pressurizing path 46 flows while swirling, a portion of the fuel in the first pressurizing path 46 flows into the concavity 56 through the through-hole 58 as shown by the arrow S1 in FIG. 10.

As described above, a through-hole 58 opens at a position that is offset toward a front side of the bottom surface 54*f*. Specifically, the opening of the through-hole 58 in the front side area of the bottom surface 54*f* (i.e., the area more toward the front side than the middle portion IX-IX) has an area larger than the opening of the through-hole 58 in the back side area of the bottom surface 54*f* (i.e., the area more toward the back side than the middle portion IX-IX) (refer to FIG. 7 and FIG. 8). In addition, the through-hole 58 opens at a position that is offset toward an outer side of the bottom surface 54*f*. Specifically, the opening of the through-hole 58 in the outside area of the bottom surface 54*f* (i.e., the area more toward the outer side than the middle portion CL) has an area larger than the opening of the through-hole 58 in the inside area of the bottom surface 54*f* (i.e., the area more toward the inner side than the middle portion CL) (refer to FIG. 8). By forming the through-hole 58 in this manner, the extent to which the fuel flow that is swirling in the concavity 54 and the fuel flow that is flowing from the concavity 54 into the through-hole 58 act upon each other is suppressed. Therefore, fuel flow disruptions are suppressed.

In addition, in an area of the impeller 50 that is lower than the medium portion CS, the back surface 58*a* of the through-hole 58 is inclined at an angle that is substantially identical to that of the back surface 54*b* of the concavity 54 (that is, it is inclined by an angle W1 with respect to the bottom face 50*b* of the impeller 50 (refer to FIG. 7)). Therefore, the fuel can flow smoothly from the concavity 54 into the through-hole 58, and fuel flow disruptions are thereby suppressed.

Fuel that flows from the through-hole 58 into the concavity 56 flows from the upstream side to the downstream side while swirling through the second pressurizing path 44. As described above, because each concavity 56 is formed identically to each concavity 54, the fuel in the second pressurizing path 44 flows similarly to the fuel that is flowing through the first pressurizing path 46. Specifically, the fuel in the second pressurizing path 44 flows smoothly from the upstream side toward the downstream side while swirling. Therefore, the fuel is advantageously pressurized while flowing through the second pressurizing path 44.

Once the fuel has flowed while swirling through the pressurizing paths 44 and 46, and has arrived at the downstream end of the second pressurizing path 44, the fuel is fed from the discharge opening 43 into the motor portion 12. The fuel that has been fed into the motor portion 12 passes through the motor portion 12 and is fed to the outside of the Wesco pump 10 from the discharge port 48.

As has been explained above, in the Wesco pump 10 of the present representative embodiment, the front-opening area 54*g* (56*g*) in proximity to the opening in the front surface 54*a* (56*a*) of the concavity 54 (56) is formed in a convex spherical shape. Specifically, the front-inner area between the middle portion and the inner end of the front surface 54*a* (56*a*) is formed into a convex shape in the longitudinal cross-section along the circumferential direction of the impeller 50. In addition, the front opening edge 55*a* (57*a*) of the concavity 54 (56) is formed such that the inner end A1 (G1) thereof is positioned closest to the front side and the middle point C1 (I1) is positioned closest to the back side. In addition, the angle between the front opening edge 55*a* (57*a*) and the inner opening edge 55*d* (57*d*) is less than 60°. Additionally, the front opening edge 55*a* (57*a*) and the outer opening edge 55*c* (57*c*) are connected by an arc that has a radius R1, and the front opening edge 55*a* (57*a*) and the inner opening edge 55*d* (57*d*) are connected by an arc that has a radius R2, which is smaller than the radius R1. In addition, the partition wall 53 (59) between adjacent concavities 54 (56) is formed so as to become thinner from the middle portion of the inner edge and the outer edge toward the inner edge. Therefore, during the rotation of the impeller 50, the fuel flows smoothly from the grooves 38*a* and 40*a* into the concavities 54 and 56. Therefore, fuel flow disruptions are suppressed.

In addition, in the Wesco pump 10 described above, the inner surface 54*d* of the concavity 54 (55) is inclined toward the center of the impeller 50. In addition, the front-bottom area 54*h* (56*h*) of the front surface 54*a* of the concavity 54 (55) is inclined at an acute angle W1 (W3) with respect to the impeller 50. Furthermore, the angle W2 (W4) between the bottom surface 54*f* (56*f*) and the front surface 54*a* (56*a*) is about 90°. That is, the sum of the angle W1 (W3) and the angle W2 (W4) is less than 180°. In addition, the bottom surface 54*f* (56*f*) of the concavity 54 (56) is smoothly connected to the back surface 54*b* by a curved surface. In addition, the bottom surface 54*f* (56*f*) of the concavity 54 (56) is connected to the inner surface 54*d* and the outer surface 54*c* by a smooth surface. Therefore, fuel flows without stagnation in the concavity 54 (56). The fuel flow disruptions are thereby suppressed.

In addition, in the Wesco pump 10 described above, the through-hole 58 is formed such that the area of the opening in the area closer to the front side than the middle portion IX-IX of the bottom surface 54*f* (56*f*) is larger than the area of the opening in the area closer to the back side of the middle portion IX-IX. In addition, in the area that is higher than the medium portion CS in the thickness direction of the impeller, the back surface 58*b* of the through-hole 58 is inclined at an angle that is substantially identical to that of the back surface 56*b* of the concavity 56. In addition, in the area that is lower than the medium portion CS in the thickness direction of the impeller, the back surface 58*b* of the through-hole 58 is inclined at an angle that is substantially identical to that of the back surface 54*b* of the concavity 54. Furthermore, the through-hole 58 is formed such that the area of the opening in the area closer to the outside than the middle portion CL of the bottom surface 54*f* (56*f*) is larger than the area of the opening in the area closer to the inside of the middle portion CL. Therefore, the fuel flows smoothly from the concavity 54 (56) into the through-hole 58, and fuel flow disruptions are suppressed.

Figure 11:
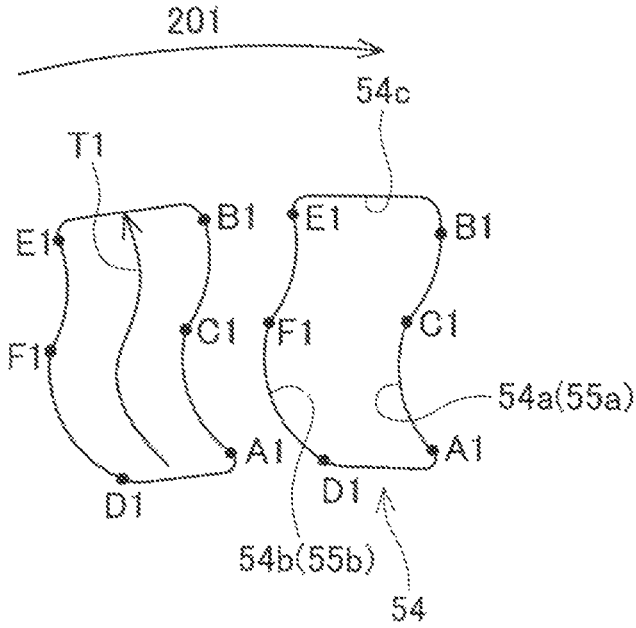
FIG. 11 is an enlarged drawing of an alternative embodiment of the concavity 54.

Note that in the embodiment described above, the front opening edge 55*a* (57*a*) of the concavity 54 (56) is formed such that the inner end A1 (G1) thereof is positioned closest to the front side, and the middle point C1 (I1) thereof is positioned closest to the back side. Furthermore, the back opening edge 55*b* (57*b*) is formed such that the inner end D1 (J1) thereof is positioned closest to the front side, and the middle point F1 (L1) thereof is positioned closest to the back side. However, each of the concavities 54 (56) may be formed into the shape that is shown in FIG. 11. In FIG. 11, the front opening edge 55*a* is formed such that the area between the inner end A1 and the middle point C1 is convex, and the area between the middle point C1 and the outer end B1 is concave. In addition, the back opening edge 55*b* is formed such that the area between the inner end D1 and the middle point F1 is concave, and the area between the middle point F1 and the outer end E1 is convex. When a concavity 54 is formed in this manner, the fuel flows in the concavity 54 as indicated by the arrow T1 in FIG II. Specifically, the fuel in the concavity 54 flows out into the groove 40*a* somewhat toward the back side. Therefore, the outflow of fuel from the concavity 54 becomes smoother, and it is possible to thereby suppress fuel flow disruptions.

Figure 12:
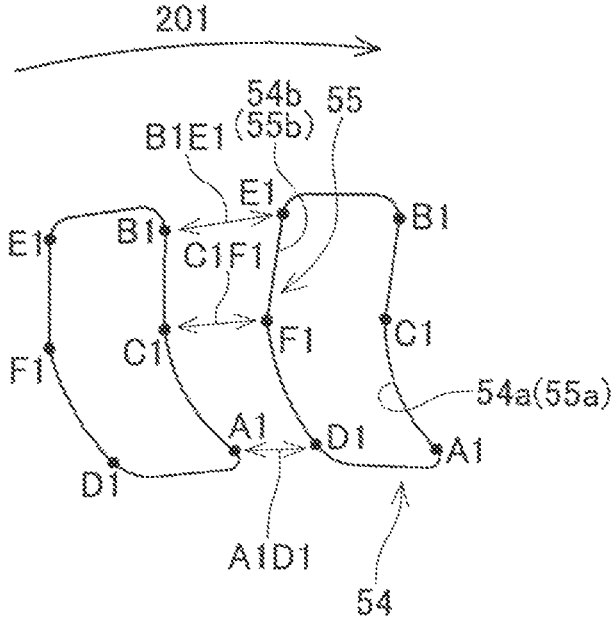
FIG. 12 is an enlarged drawing of an alternative embodiment of the concavity 54.

Furthermore, in the embodiment described above, the partition walls 53 are formed so as to become thinner from the middle portion C1F1 toward the outer edge B1E1. However, in the present teachings, forming the impeller in this manner is not necessary. For example, the concavity 54 (56) may be formed into the shape that is shown in FIG. 12. In FIG. 12, the inner end A1 of the front opening edge 55*a* is positioned closest to the front side. The inner end D1 of the back opening edge 55*b* is positioned closest to the front side. In addition, in FIG. 12, the partition wall 53 becomes thinner from the middle portion C1F1 toward the inner edge A1D1. In contrast, the outer edge B1E1 of the partition wall 53 is formed such that it is thicker than the middle portion C1F1. It is also possible to suppress fuel flow disruptions using a concavity that has such a shape.

Figure 13:
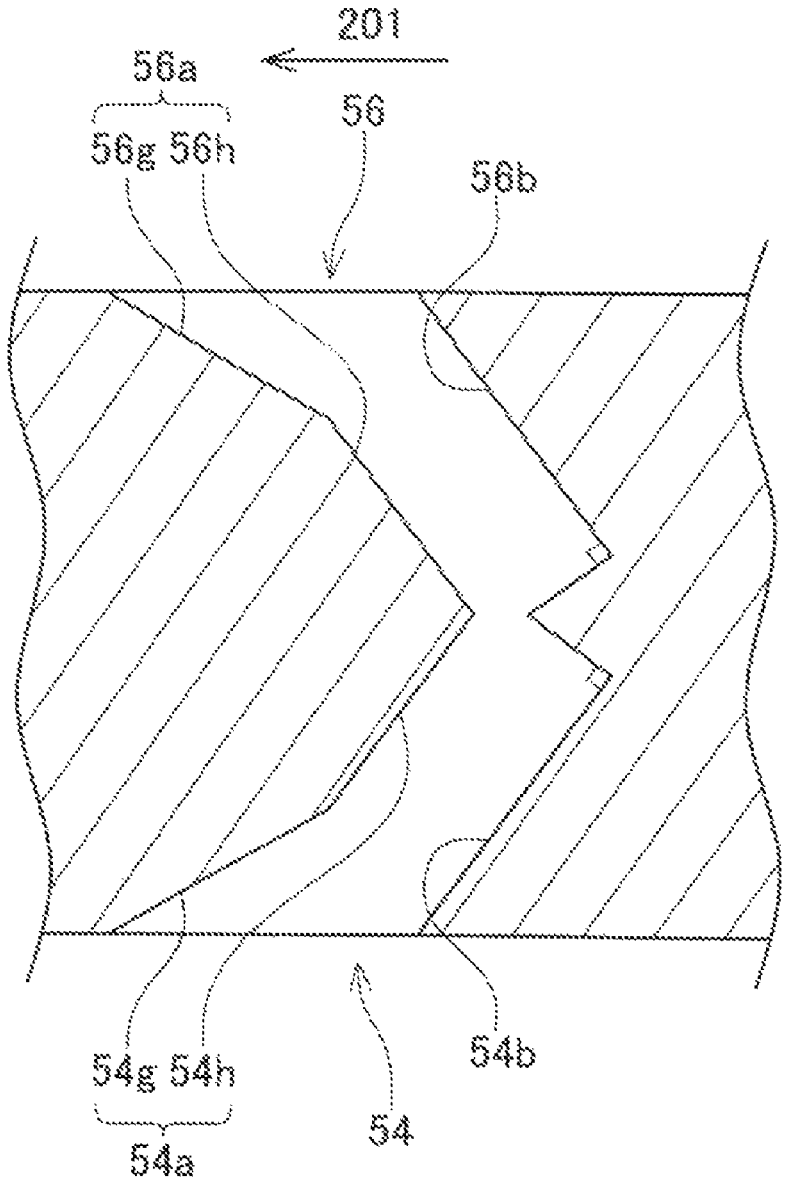
FIG. 13 is a drawing that shows a cross-sectional shape, which corresponds to FIG. 7, of the concavities 54 and 56 of an alternative embodiment.

Furthermore, in the embodiment shown above, as shown in FIG. 5, in the front surface 54*a* (56*a*) of the concavity 54 (56), the front-opening area 54*g* (56*g*) is formed into a convex spherical shape. However, as shown in FIG. 13, in the front surface 54*a* (56*a*), the front-opening area 54*g* (56*g*) may be formed into a flat planar shape. In FIG. 13, the front surface 54*a* (56*a*) has a convex shape because the angles at which the front-opening area 54*g* (56*g*) and the front-bottom area 54*h* (56*h*) incline differ. It is also possible to suppress fuel flow disruptions by forming the front surface 54*a* (56*a*) in this manner.

Figure 14:
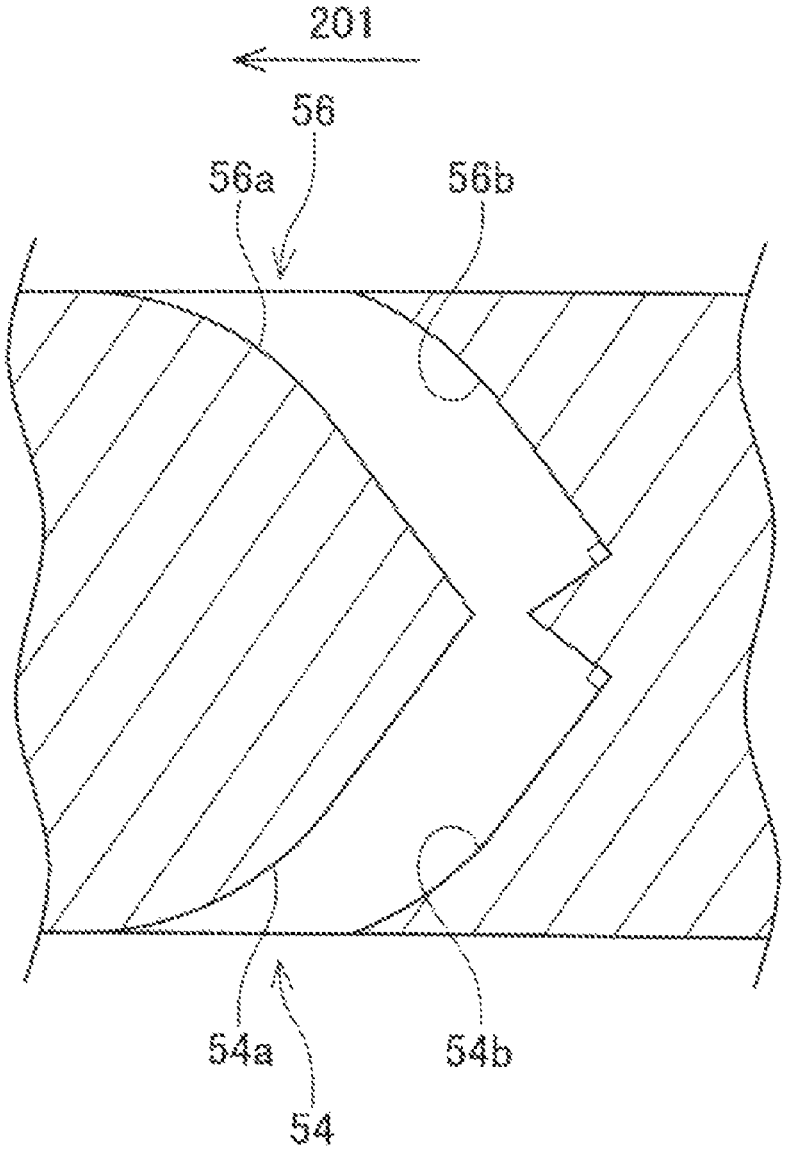
FIG. 14 is a drawing that shows a cross-sectional shape, which corresponds to FIG. 7, of the concavities 54 and 56 of an alternative embodiment.
Figure 15:
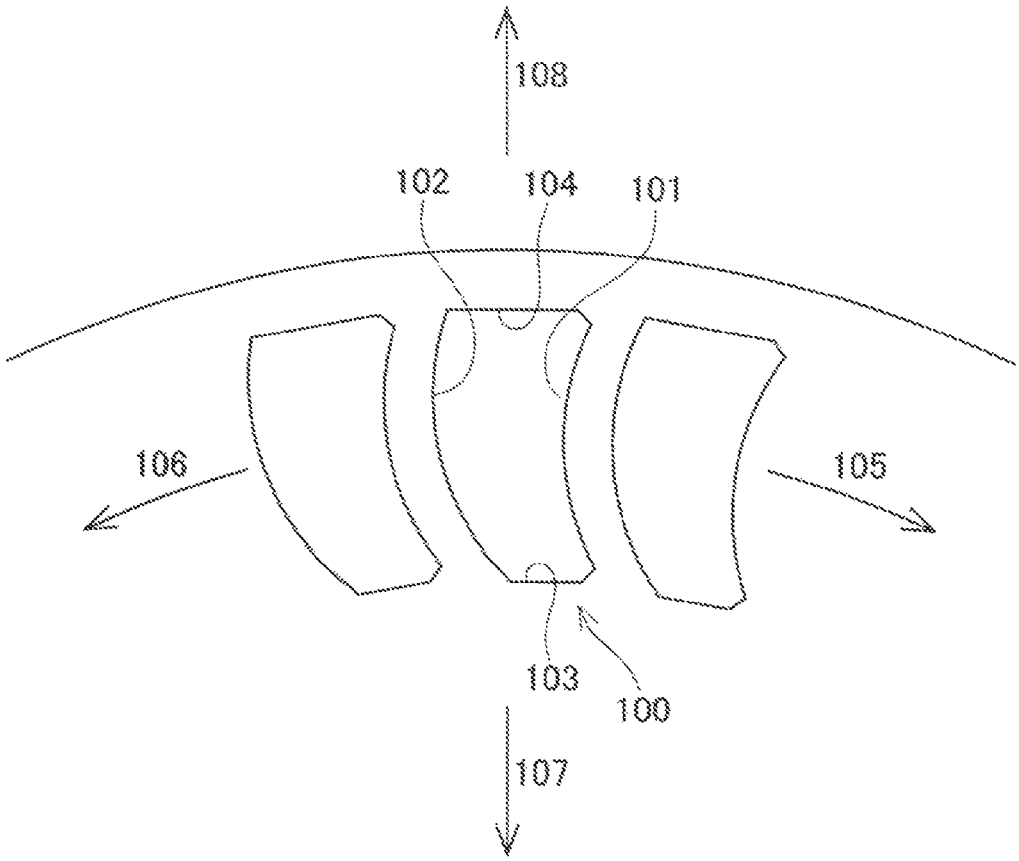
FIG. 15 is an enlarged drawing of an impeller representative of conventional technology.

In addition, as shown in FIG. 14, the shape of the back surface 54*b* (56*b*) may be formed into a concave shape according to the shape of the front surface 54*a* (56*a*).

Finally, although the preferred representative embodiment has been described in detail, the present embodiment is for illustrative purpose only and is not restrictive. It is to be understood that various changes and modifications may be made without departing from the spirit or scope of the appended claims. In addition, the additional features and aspects disclosed herein also may be utilized singularly or in combination with the above aspects and features.

What is claimed is:

1. A disc shaped impeller comprising an upper face and a lower face, wherein:

a plurality of concavities are repeatedly arranged along a circumferential direction on the upper face and the lower face, each concavity including a front surface, a back surface, an inner surface, an outer surface and a bottom surface;

each front surface includes a front-inner area formed between an inner edge of the front surface and a middle portion of the front surface; and each front-inner area is formed in a convex shape when viewed as a longitudinal cross-section, the longitudinal cross-section defined as a cross-section through a longitudinal plane perpendicular to the upper face and disposed so as to be aligned along the circumferential direction.

2. The impeller of claim 1, wherein each front-inner area is formed in a curved shape at the longitudinal cross section.

3. The impeller of claim 1, wherein each front surface includes a front-outer area formed between an outer edge of the front surface and the middle portion of the front surface, and each front-outer area is formed in a convex shape at the longitudinal cross-section.

4. The impeller of claim 1, wherein:

each concavity includes a front opening edge, which is an intersection of the front surface and the upper or lower face of the impeller, and a back opening edge, which is an intersection of the back surface and the upper or lower face of the impeller;

each front opening edge is formed so that a middle point of the front opening edge is located more toward a back direction opposite to a direction of rotation of the impeller than an inner end of the front opening edge and an outer end of the front opening edge; and each back opening edge is formed so that a middle point of the back opening edge is located more toward the back direction than an inner end of the back opening edge and an outer end of the back opening edge.

5. The impeller of claim 1, wherein:

each concavity includes a front opening edge, which is an intersection of the front surface and the upper or lower face of the impeller, and a back opening edge which is an intersection line of back surface and the upper or lower face of the impeller;

each front opening edge is formed so that an inner end of the front opening edge is located at a most forward position toward a direction of rotation of the impeller in the front opening edge; and each back opening edge is formed so that an inner end of the back opening edge is located at a most forward position toward the direction of rotation in the back opening edge.

6. The impeller of claim 1, wherein:

each concavity includes a front opening edge, which is an intersection of the front surface and the upper or lower face of the impeller, and a back opening edge, which is an intersection of the back surface and the upper or lower face of the impeller;

each front opening edge is formed so that an inner area between an inner end of the front opening edge and a middle point of the front opening edge is formed in a convex shape and an outer area between the middle point of the front opening edge and an outer end of the front opening edge is formed in a concave shape; and each back opening edge is formed so that an inner area between an inner end of the back opening edge and a middle point of the back opening edge is formed in a concave shape and an outer area between the middle point of the back opening edge and an outer end of the back opening edge is formed in a convex shape.

7. The impeller of claim 1, wherein:

each concavity includes a front opening edge, which is an intersection of the front surface and the upper or lower face of the impeller, and an inner opening edge, which is an intersection of the inner surface and the upper or lower face of the impeller; and an angle between the front opening edge and the inner opening edge at an intersecting point is less than 60 degrees for each concavity.

8. The impeller of claim 7, wherein the inner opening edge is smoothly connected to the front opening edge of each concavity.

9. The impeller of claim 8, wherein each concavity further includes an outer opening edge, which is an intersection of the outer surface and the upper or lower face of the impeller, and wherein the outer opening edge is smoothly connected to the front opening edge of each concavity.

10. The impeller of claim 9, wherein a first connecting portion, which in each concavity connects the outer opening edge and the front opening edge, is formed in a circularly arced shape with a first radius, and a second connecting portion, which in each concavity connects the inner opening edge and the front opening edge, is formed in a circularly arced shape with a second radius smaller than the first radius.

11. The impeller of claim 1, wherein each pair of adjacent concavities is separated by a partition wall, and each partition wall is formed so that the width of the partition wall narrows from a middle portion of the partition wall toward an inner edge of the partition wall.

12. The impeller of claim 1, wherein the bottom surface is smoothly connected to the inner surface and the outer surface by a curved surface in each concavity.

13. The impeller of claim 1, wherein the bottom surface is smoothly connected to the back surface by a curved surface in each concavity.

14. The impeller of claim 1, wherein:

the bottom surface is formed in a flat shape;

each concavity on the upper face includes a first front-bottom area which is a part of the front surface in proximity to the bottom surface, each concavity on the lower face includes a second front-bottom area which is a part of the front surface in proximity to the bottom surface;

the first front-bottom area is inclined toward a direction of rotation of the impeller, an inclination angle of the first front-bottom area with respect to the upper face of the impeller is an acute angle W1, an angle between the bottom surface and the first front-bottom area is an angle W2, and a total angle, which is the sum of the acute angle W1 and the angle W2, is less than 180 degrees; and the second front-bottom area is inclined toward the direction of rotation of the impeller, an inclination angle of the second front-bottom area with respect to the lower face of the impeller is an acute angle W3, an angle between the bottom surface and the second front-bottom area is an angle W4, and a total angle, which is the sum of the acute angle W3 and the angle W4, is less than 180 degrees.

15. The impeller of claim 14, wherein each pair of concavities on the upper and lower faces communicates via a through-hole, each through-hole includes a front opening, which is an opening in an area between a front edge of the bottom surface and a middle portion of the bottom surface, and a back opening which is an opening in an area between a back edge of the bottom surface and the middle portion of the bottom surface, and the front opening is larger than the back opening.

16. The impeller of claim 15, wherein each concavity on the upper face includes a first back-bottom area which is a part of the back surface in proximity to the bottom surface, each concavity on the lower face includes a second back-bottom area which is a part of the back surface in proximity to the bottom surface, each through-hole includes a back surface having an upper area and a lower area, the upper area being an area upper than a medium portion, which is located at a middle of the impeller in a thickness direction of the impeller, the lower area being an area lower than the medium portion, each first back-bottom area is inclined toward the direction of rotation, each second back-bottom area is inclined toward the direction of rotation, and each upper area is inclined toward the direction of rotation at an angle that is identical to an angle of the first back-bottom area, and each lower area is inclined toward the direction of rotation at an angle that is identical to an angle of the second back-bottom area.

17. The impeller of claim 14, wherein each pair of concavities on the upper and lower faces communicates via a through-hole, each through-hole includes an outer opening, which is an opening in an area between an outer edge of the bottom surface and a middle portion of the bottom surface, and an inner opening which is an opening in an area between an inner edge of the bottom surface and the middle portion of the bottom surface, and the outer opening is larger than the inner opening.

18. The impeller of claim 1, wherein each inner surface is inclined toward a center of rotation of the impeller at a second longitudinal cross-section, the second longitudinal cross-section defined as a cross-section through a longitudinal plane perpendicular to the upper surface and disposed so as to be aligned along the radial direction.

19. A disc shaped impeller comprising an upper face and a lower face, wherein:

a plurality of concavities are repeatedly arranged along a circumferential direction on the upper face and the lower face, each concavity including a front opening edge, which is an intersection of the front surface and the upper or lower face of the impeller, and a back opening edge which is an intersection of the back surface and the upper or lower face of the impeller;

each front opening edge is formed so that an inner area between an inner end of the front opening edge and a middle point of the front opening edge is formed in a convex shape and an outer area between the middle point of the front opening edge and an outer end of the front opening edge is formed in a concave shape; and each back opening edge is formed so that an inner area between an inner end of the back opening edge and a middle point of the back opening edge is formed in a concave shape and an outer area between the middle point of the back opening edge and an outer end of the back opening edge is formed in a convex shape.

20. A disc shaped impeller comprising an upper face and a lower face, wherein:

a plurality of concavities are repeatedly arranged along a circumferential direction on the upper face and the lower face, each concavity includes a front surface and a bottom surface which is formed in a flat shape, each concavity on the upper face includes a first front-bottom area, which is a part of the front surface in proximity to the bottom surface, each concavity on the lower face includes a second front-bottom area which is a part of the front surface in proximity to the bottom surface;

the first front-bottom area is inclined toward a direction of rotation of the impeller, an inclination angle of the first front-bottom area with respect to the upper face of the impeller is an acute angle W1, an angle between the bottom surface and the first front-bottom area is an angle W2, and a total angle, which is the sum of the acute angle W1 and the angle W2, is less than 180 degrees; and the second front-bottom area is inclined toward the direction of rotation of the impeller, an inclination angle of the second front-bottom area with respect to the lower face of the impeller is an acute angle W3, an angle between the bottom surface and the second front-bottom area is an angle W4, and a total angle, which is the sum of the acute angle W3 and the angle W4, is less than 180 degrees.

21. The impeller of claim 20, wherein each concavity on the upper face includes a first bottom-front area formed between a front edge of the bottom surface and middle portion of the bottom surface, each concavity on the lower face includes a second bottom-front area formed between a front edge of the bottom surface and middle portion of the bottom surface, and each pair of concavities on the upper and lower faces communicates via a through-hole, each through-hole connecting the first bottom-front area with the second bottom-front area.

22. The impeller of claim 21, wherein each concavity includes a back surface, each concavity on the upper face includes a first back-bottom area that is a part of the back surface in proximity to the bottom surface, each concavity on the lower face includes a second back-bottom area that is a part of the back surface in proximity to the bottom surface, each through-hole includes a back surface having an upper area and a lower area, the upper area being an area upper than a medium portion which is located at a middle of the impeller in a thickness direction of the impeller, the lower area being an area lower than the medium portion, each first back-bottom area is inclined toward the direction of rotation, each second back-bottom area is inclined toward the direction of rotation, and each upper area is inclined toward the direction of rotation at an angle that is identical to an angle of the first back-bottom area, and each lower area is inclined toward the direction of rotation at an angle that is identical to an angle of the second back-bottom area.

23. A fuel pump, comprising;

the impeller of claim 1, and a casing for housing the impeller so that the impeller can rotate within the casing.

* * * * *